US005827995A

United States Patent [19]

Graham

[11] Patent Number: 5,827,995

[45] Date of Patent: Oct. 27, 1998

[54] REACTIVE PRODUCTS HAVING TIN AND TIN ALLOY LINERS AND SHEATHS

[75] Inventor: John A. Graham, Middletown, Conn.

[73] Assignee: The Ensign-Bickford Company, Simsbury, Conn.

[21] Appl. No.: 788,114

[22] Filed: Jan. 23, 1997

Related U.S. Application Data

[63] Continuation-in-part of Ser. No. 770,419, Dec. 20, 1996, abandoned, which is a continuation of Ser. No. 587,823, Jan. 19, 1996, abandoned, which is a continuation of Ser. No. 417,438, Apr. 5, 1995, abandoned, which is a continuation of Ser. No. 262,474, Jun. 20, 1994, abandoned.

[51] Int. Cl.[6] ..... F42B 1/02; C06C 5/04

[52] U.S. Cl. ..... 102/307; 102/275.8

[58] Field of Search ..... 102/307

[56] References Cited

U.S. PATENT DOCUMENTS

| | | | |
|---|---|---|---|
| 3,607,253 | 9/1971 | Cain et al. | 75/175 A |
| 4,670,217 | 6/1987 | Henson et al. | 420/562 |
| 4,806,309 | 2/1989 | Tulman | 420/562 |
| 5,331,895 | 7/1994 | Bourne et al. | 102/307 |
| 5,333,550 | 8/1994 | Rodney et al. | 102/331 |
| 5,501,154 | 3/1996 | Rodney et al. | 102/331 |

*Primary Examiner*—Peter A. Nelson
*Attorney, Agent, or Firm*—Law Office of Victor E. Libert; Victor E. Libert; Frederick A. Spaeth

[57] ABSTRACT

The liner (16) and, optionally, the tamper (12) of a shaped charge and the sheathing of mild detonating cord, ignition cord, delay cord, etc., are advantageously made of a tin-copper- or tin-silver-based alloy that is preferably substantially lead-free and that contains not more than about 1 percent antimony. Certain of these alloys generally contain about 97 to 99.9 percent tin, and from 0.1 to 3 percent copper, and optionally not more than 1 percent antimony. Other embodiments contain from 96 to 99.5 percent tin and from 0.5 to 4 percent silver and are substantially free of antimony. Tin-silver alloys for use in the invention preferably have elongations of about 88 and densities that are generally greater than those of the tin-copper alloys.

21 Claims, 1 Drawing Sheet

REACTIVE PRODUCTS HAVING TIN AND TIN ALLOY LINERS AND SHEATHS

CROSS-REFERENCE TO RELATED APPLICATIONS

This application is a continuation-in-part of patent application Ser. No. 08/770,419, filed on Dec. 20, 1996 in the name of John A. Graham et al and entitled "Explosive Shaped Charge Liner Utilizing Tin-Based Alloy Metal" which is a continuation of Ser. No. 08/587,823, filed on Jan. 11, 1996, in the name of John A. Graham et al and entitled "Explosive Shaped Charge Liner Utilizing Tin-Based Alloy Metal", which is a continuation of patent application Ser. No. 08/417,438, filed on Apr. 5, 1995, in the name of John A. Graham et al and entitled "Explosive Shaped Charge Liner Utilizing Tin-Based Alloy Metal", which in turn is a continuation of patent application Ser. No. 08/262,474, filed Jun. 20, 1994, in the name of John A. Graham et al and entitled "Explosive Shaped Charge Liner Utilizing Tin-Based Alloy Metal" all now abandoned.

BACKGROUND OF THE INVENTION

1. Field of the Invention

This invention relates to tin and tin alloy liners and sheaths for explosive and pyrotechnic materials and in particular, to tin alloys used for liners for both conical and linear shaped charges and for sheaths for linear explosives and pyrotechnics generally.

Shaped charges generally comprise a concave tamper which receives explosive material and a metallic liner that holds the explosive material in place and which defines and maintains the explosive material in a concave configuration to focus the energy of detonation. Upon detonation, the liner forms a penetrating jet which is directed towards a target. Thus, a conical shaped charge can be used to perforate a target such as an oil well casing or armor plating, and a linear shaped charge can be used for cutting a target material or structure. The materials used for the liner are chosen to be sufficiently malleable to facilitate manufacture of the shaped charge and to provide adequate penetrating or cutting performance with respect to the target. Liners for shaped charges have conventionally been made of lead, aluminum, copper, silver and their respective alloys. Conventionally, linear explosive and pyrotechnic products, such as mild detonating cord, ignition cord, rapid deflagrating cord, linear shaped charge and delay cord, comprise an explosive, deflagrating or pyrotechnic material disposed within an outer sheath made of malleable metals such as tin, aluminum and lead, or their respective alloys. Lead is beneficial for its high density, which yields good penetration, but lead inhibits X-ray inspection of the interior of the product and poses health and environmental hazards. Aluminum has good properties with regard to processing and it permits X-ray inspection, but it is less dense than lead and so does not achieve the same target penetration under some conditions.

2. Related Art

U.S. Pat. No. 5,333,550 to Rodney et al, dated Aug. 2, 1994, discloses several tin alloys for use as a sheath material for explosive/pyrotechnic linear products. The alloys include (a) a ternary composition of 96.5 percent tin, 1.5 percent copper and 2 percent antimony; (b) a binary composition of 97 percent tin and 3 percent antimony; and (c) a quaternary composition of 98.5 percent tin, 1 percent bismuth, 0.25 percent copper and 0.25 percent silver. Lead may be present in amounts of up to 1.42 percent, as an impurity.

U.S. Pat. No. 5,501,154 to Rodney et al, dated Mar. 26, 1996, discloses tin-based alloys for use as sheath materials in explosive pyrotechnic products, including an alloy containing 96.5 to 98 percent tin, 2 to 3 percent antimony and 0.09 to 1.42 percent lead.

U.S. Pat. No. 3,128,701 to Rinehart et al, dated Apr. 14, 1964, discloses a variety of alloys for use as liners in shaped charges, including an alloy comprising 91 percent tin, 8 percent antimony and 0.6 percent nickel.

German patent document 29 01 500 discloses a shaped charge liner alloy comprising 95 percent tin and 5 percent bismuth.

U.S. Pat. No. 3,147,707 to Caldwell, dated Sep. 8, 1964, discloses lead-based liner alloys comprising tin, antimony and copper.

U.S. Pat. Nos. 1,923,761 to Snelling et al, dated Aug. 22, 1933, and 2,982,210 to Andrew et al, dated May 2, 1961, broadly teach the use of tin or tin alloys (or lead) as sheathing material for detonating cord.

U.S. Pat. No. 3,903,800 to Kilmer, dated Sep. 9, 1975, discloses that detonating cord sheath may be made "of tin, lead or other suitable metal or alloy" (column 1, lines 15–18).

Some ignition cord manufactured for use in automotive air bag inflators are known to comprise tin-based alloy tubes that contain a core of deflagrating material. Such ignition cords are used to initiate a surrounding charge of explosive material such as sodium azide which, upon such initiation, generates gases that inflate the air bag. As is understood in the art, the tube of an ignition cord is designed to shatter radially, as well as to propagate linearly, to allow the hot gases and particles produced by the explosive core material to eject radially into the surrounding deflagrating material. Detonating cord is designed to propagate a reaction linearly along the cord but may also be designed to explode radially. On the other hand, the function of a liner for a linear or conical shaped charge is to develop cutting or penetrating action by using the explosive force to form from the liner a high-velocity metal jet and propel it towards a target. The satisfactory performance of a metal or metal alloy as a sheath for detonating cord does not imply that the alloy will perform satisfactorily as the liner of a shaped charge.

SUMMARY OF THE INVENTION

In accordance with the present invention there is provided a reactive product comprising a sheath at least partially encasing a reactive material selected from the group consisting of explosive material, deflagrating material, pyrotechnic material and mixtures of two or more thereof. Generally, the sheath comprises a tin-based alloy containing from 96 to 99.9 percent tin; one of (a) from 0.1 to 3 percent copper, (b) from about 0.1 to 4 percent silver; and not more than about 1 percent antimony. For example, such alloys may be substantially free of bismuth.

In an alternative embodiment, the sheath may comprise a substantially silver-free tin-based alloy comprising from 97 to 99.9 percent tin; from 0.1 to 3 percent copper and not more than about 1 percent antimony. For example, the alloy may comprise at least about 97.5 percent tin and 1.5 percent or less copper. Alternatively, the tin-based alloy may be comprised of about 97 percent tin and about 3 percent copper. Still other embodiments of the alloy may contain more than 99.5 percent tin, and/or less than 0.5 percent antimony and/or less than 0.25 percent copper.

In another embodiment, the sheath may comprise a substantially copper-free tin-based alloy comprising about 96 to 99.9 percent tin; from about 0.1 to 4 percent silver; and not more than about 1 percent antimony. The alloy may consist essentially of tin and silver and may have an elongation of greater than about 30 percent and a density of about 0.264 pounds per cubic inch.

Another aspect of the present invention provides that the reactive material may be in the form of a linear core and the sheath may be in the form of a linear sheath circumferentially surrounding the core. Thus, the reactive product may comprise detonating cord, ignition cord, or delay cord.

Yet another aspect of the present invention provides that the tin-based alloy may comprise the liner of a shaped charge, e.g., a conical-shaped charge or a linear-shaped charge. The shaped charge may include a tamper and a shaped explosive material having a concave surface. The explosive material may be disposed against the tamper with the concave surface of the explosive material facing away from the tamper. The liner may be attached to the tamper to line the concave surface of the explosive material and cooperate with the tamper to surround the explosive material between the tamper and the liner. In various embodiments, the shaped charge may comprise a conical-shaped charge or a linear-shaped charge.

As used herein and in the claims, the following terms have the stated meanings.

The term "concave", as used to describe the configuration of a surface, is intended to include the interior surface of a linear angled strip, i.e., the non-reflex angled surface, as well as the interior of a generally conical-, pyramidal- or hemispherical-shaped surface.

The term "reactive material" means an explosive material, a deflagrating material, a pyrotechnic material, or a mixture of two or more such materials.

The term "reactive product" means a product containing a reactive material and therefore includes, by way of illustration and not limitation, detonating cord, ignition cord, linear-shaped charges and conical-shaped charges.

The term "sheath" means a liner, cover or casing of a reactive product, which liner, cover or casing surrounds, or at least partly covers, a core of reactive material.

The term "modern pewter" or "modern pewter alloy" shall mean a tin alloy containing from about 90 to 98 percent tin, from about 1 to 8 percent antimony and from about 0.25 to 3 percent copper.

Throughout the description of the invention and the appended claims, the stated percentages of components in an alloy or metal indicate percentages by weight of the total weight of the alloy or metal.

DETAILED DESCRIPTION OF THE INVENTION AND PREFERRED EMBODIMENTS THEREOF

Figure 1:
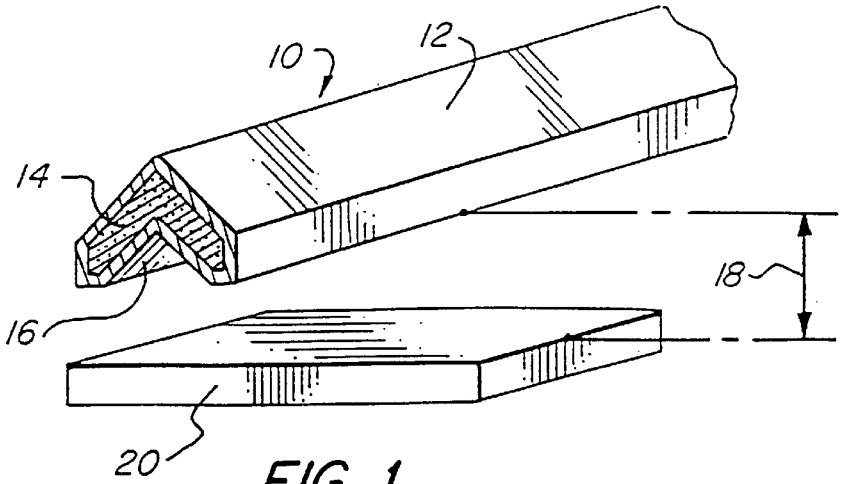
FIG. 1 is a schematic, partly cross-sectional, perspective view of a linear-shaped charge including a liner, in accordance with one embodiment of the present invention.

The present invention relates to the use of tin-copper and tin-silver alloys not previously used in liners for shaped charges or for sheaths for linear reactive products. As will be demonstrated below, reactive products having sheaths comprised of the alloys used in accordance with the present invention can be manufactured using the same processing steps used for conventional lead-based products and they function as well as conventional lead-based products. Based on their physical properties, the tin-silver alloys of the present invention are believed to work as well as the copper-containing alloys.

The present invention addresses a need in the art to avoid the use of certain heavy metals, particularly lead and lead-based alloys, and a desire to reduce or eliminate the use of antimony in sheaths and liners. These metals and alloys are disfavored because of the health and environmental hazards they pose. Accordingly, alloys according to the present invention may be broadly described as comprised of tin, which generally comprises from about 96 to 99.9 percent by weight of the alloy, and copper or silver in amounts of at least 0.1 percent to 3 or 4 percent, respectively, to the substantial exclusion of lead, and as containing not more than about 1 percent antimony. Optionally, alloys used for the present invention may also be substantially free of bismuth.

If the terms "consisting of" or "consisting essentially of" are used in specifying constituents of the alloys of the present invention, or if an alloy is described as being comprised of constituent metals in proportions that may add up to 100 percent, these terms should not be construed to foreclose the presence of trace quantities of lead, bismuth or other metals that are commonly present in commercially produced tin-based alloys. Similarly, alloys described herein as being "substantially free of" such metals may nevertheless include them in trace amounts, i.e., not more than 0.05 percent by weight of the alloy. Accordingly, a quantity of lead or antimony, e.g., up to about 0.05 percent each, may be present as trace impurities in a nominally lead- and/or antimony-free alloy. Alternatively, an alloy "consisting essentially of tin and copper" or, e.g., "comprising about 97 percent tin and about 3 percent copper", may contain, e.g., up to about 0.015 percent iron and 0.005 percent zinc as trace impurities and these and any other trace impurities will not be considered to be alloying constituents.

Further, tin-based alloys as described herein can be used advantageously for liner or sheath material in high radiation environments, since they do not readily absorb thermal neutrons which cause a heating effect in other commonly used liner or sheath materials. In addition, linear-shaped charges and linear reactive products in accordance with the present invention lend themselves to inspection for manufacturing defects by using radiographic X-ray, a technique that is obviously less effective or not possible with shaped charges or sheathed reactive products comprising lead-based liners or sheaths.

Conical and linear shaped charges and linear reactive products comprising the tin alloys in accordance with the present invention may be produced using conventional techniques well-known to those skilled in the art. For example, in those embodiments in which the tamper and the liner of a shaped charge are made of the same material, a chevron-shaped tube made of a tin alloy in accordance with the present invention may be co-extruded with explosive material. Alternatively, the linear-shaped charge 10 shown in FIG. 1 may be formed from a round tube made of the alloy and packed with explosive material. The packed round tube can be swaged into a cross-sectional chevron configuration, to form an angled tamper 12 and a liner 16 between which the explosive material 14 is enclosed.

Whether rolled, drawn, spun, swaged or co-extruded, the tamper and the liner of a shaped charge may be made from the same material and constitute a continuous structure, i.e., the tamper 12 and liner 16 are portions of a continuous sheath that surrounds the explosive core. FIG. 1 shows shaped charge 10 supported (by means not shown) at a stand-off distance 18 from a target 20, to illustrate one test configuration used in the trials discussed below.

For the manufacture of shaped charges, the relative thickness of the tamper and liner and the amount of explosive material disposed therein are chosen to best suit the use intended for a particular shaped charge. In some applications, as when a shaped charge is used for an aircraft pilot ejection device, it is advantageous for the tamper and the liner to be substantially the same alloy composition and thickness, so that when the shaped charge detonates, the tamper disintegrates substantially without producing shrapnel, which could severely injure the ejecting pilot.

Figure 2:
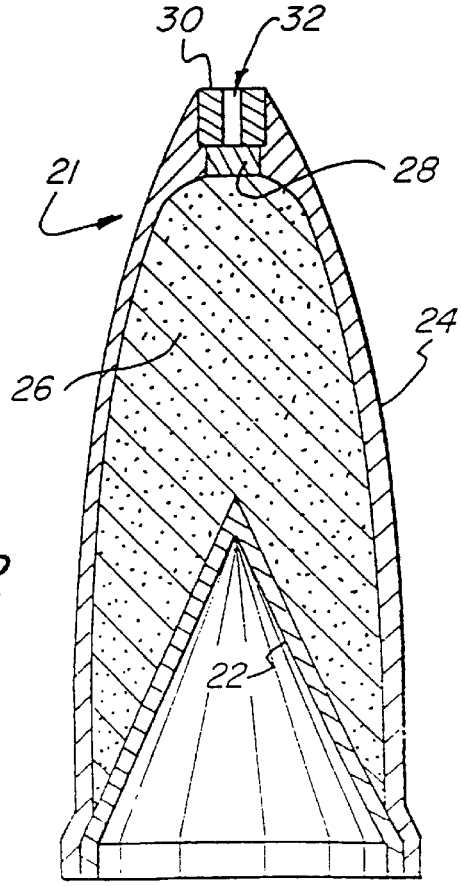
FIG. 2 is a schematic, cross-sectional view of a conical-shaped charge including a liner, in accordance with another embodiment of the present invention.

In other shaped charge embodiments, the tamper may be physically and compositionally distinct from the liner, and the two may be secured together. One example of such a shaped charge is the conical-shaped charge 21 shown schematically in FIG. 2, wherein a generally conical tin alloy liner 22 is secured to tamper 24 with explosive material 26 in a generally concavo-convex configuration therebetween. A detonating charge 28 is situated at the apex of explosive material 26, beneath a detonator housing 30. Explosive materials such as PBXN-5 (used in the Examples below) and others are well-known to those skilled in the art. Housing 30 is secured onto tamper 24 and comprises a bore 32 dimensioned and configured to receive therein a detonator (not shown) that is secured to an initiation signal transmission line (not shown) by which an initiation signal is sent to the detonator. Initiation of the detonator detonates the detonating charge 28 to fire the shaped charge. In such a configuration, the tamper 24 may comprise a material other than the tin alloy, e.g., copper, which may be chosen over the tin alloy due to the differences in their performance characteristics, e.g., for the different types of back blast they produce. Preferably, the tin alloys used as liners for linear-shaped charges in accordance with the present invention have an elongation of greater than 30 percent. These alloys may also have a tensile strength of at least about 3000 pounds per square inch (psi).

Figure 3:
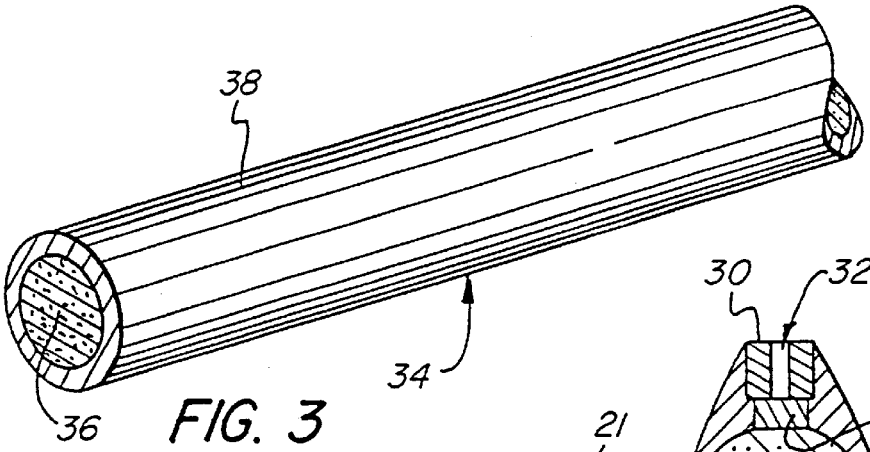
FIG. 3 is a schematic, perspective view of a linear reactive device including a sheath, in accordance with a third embodiment of the present invention.

Any of the alloy compositions disclosed herein for use in the manufacture of shaped charges may also be employed as a sheath for linear reactive products such as mild detonating cord, ignition cord and delay cord. Such detonating cord, ignition cord and delay cord may be manufactured in the known manner by multiple-step swaging or drawing operations using one of the tin alloys in accordance with the present invention. For example, a tube made of 98 percent tin, 0.5 percent antimony and 1.5 percent copper and about one inch in outside diameter and one-half inch in inside diameter may be filled with a suitable reactive material (e.g., explosive, deflagrating or pyrotechnic material) and then repeatedly drawn to reduce its outside diameter, e.g., to one-fifth to one-tenth or less, of the original outside diameter to compress the reactive composition within the reduced diameter tube and provide a mild detonating cord, an ignition cord or a delay cord. As is well-known in the art, if the tube is filled with a suitable explosive, detonating cord may be produced by the described method. Alternatively, if the tube is filled with a delay composition, i.e., a pyrotechnic material, a delay cord or fuse is produced. The delay cord may be dimensioned and configured to be cut into segments sized to fit within detonators as part of the detonator firing trains, in order to provide delay elements to establish the delay periods of the detonators. Such delay elements are of course well-known in the art but conventionally employ a lead sheath. Thus, FIG. 3 shows a linear reactive product 34, which may be a detonating cord, ignition cord or delay cord and comprises a core 36 of reactive material. The core 36 is surrounded by a sheath 38 which, in accordance with the present invention, comprises a tin alloy as disclosed herein. Suitable explosive, deflagrating and/or pyrotechnic reactive materials will be selected for core 36 depending on its intended use, as is well-known to those skilled in the art.

The following examples demonstrate that the alloys of the present invention possess the physical properties required of sheaths for reactive products. These properties include a heat capacity that is low enough so that the sheath does not extract too much heat from the reaction of the reactive material in the reactive product, malleability, tensile strength and elongation that permit the alloys to be stretched and bent without breaking or work-hardening to a significant degree. For use as a liner for a shaped charge, the alloy preferably has a high density.

EXAMPLE 1

A tube made from an alloy comprised of 97 percent tin, 2.5% copper and 0.5 percent antimony (alloy No. 1) and having an outside diameter of 1 inch and an inside diameter of 0.35 inch was filled with a pyrotechnic mixture comprising molybdenum and potassium perchlorate in pulverulent form. The tube was drawn out in a 26-step draw die process to provide a delay line reactive product having a final outer diameter of 0.255 inch. Sections of the delay line were cut into sample delay elements measuring 0.4, 0.75 and 1 inch in length and were tested by incorporating them into detonators and observing the delay intervals they interposed between the receipt of an initiation signal and detonation of the detonators.

The samples exhibited a good linearity between their delay intervals and their lengths with a statistical correlation coefficient of 0.999. (Perfect linearity would yield a correlation coefficient of 1.0.)

EXAMPLE 2

Further time delay elements were made according to the procedure described above in Example 1, but the tube, which had an outer diameter of 1 inch and a 0.35 inch bore, was formed from an alloy comprised of 97 percent tin and 3 percent copper (alloy No. 2). The tube was filled with the same pyrotechnic material drawn out in a 26-step process to an outer diameter of 0.255 inch. Sections of the drawn-out tube were tested as delay elements in the manner described in Example 1. These samples, too, showed a good linearity between their delay intervals and their lengths, with a correlation coefficient of 0.996.

EXAMPLE 3 (COMPARATIVE EXAMPLE)

Samples of conventional delay lines were prepared using tubes made from modern pewter and lead. A first tube of modern pewter having an outer diameter of 1 inch and an inner diameter of 0.35 inch was packed with a delay composition comprising molybdenum and potassium perchlorate. The packed tube was drawn out in a multi-step process to a final outer diameter of 0.255 inch. A second modern pewter tube sized like the first was packed with the same delay composition and was drawn out to the final outer diameter of 0.255 inch through a 17-step process. A similarly configured common lead tube (comprised of at least about 99.94% lead) was filled with the delay composition and was drawn out to a final outer diameter of 0.255 inch through a 14-step process.

Sample delay elements of varying lengths were cut from all three tubes, and the samples were tested in the manner described in Example 1. The results showed good linearity in the relationship between the length of the element and the delay interval provided. The samples from the 17-step modern pewter delay line elements had a correlation coefficient of 0.997, and the multi-step modern pewter delay elements had a correlation coefficient of 0.995. The lead delay elements had a correlation coefficient of 0.997.

EXAMPLE 4A

Linear-shaped charges were prepared with tubes made from alloy No. 1 (i.e., about 97 percent tin, 0.5 percent antimony and 2.5 percent copper) and alloy No. 2 (i.e., 97 percent tin and 3 percent copper). The tubes had outer diameters of 0.75 inch and inner diameters of 0.343 inch and were loaded with PBXN-5 to a loading density of 1.45 grams per cubic centimeter (g/cc). After being drawn and shaped, the loaded tubes yielded linear-shaped charges of the contiguous tamper-and-liner type and contained explosive core loads of about 10.4 grains per linear foot. (A conventional lead-based linear-shaped charge is drawn from a lead-based tube having a 0.75 inch outer diameter and an inner diameter of 0.45 inch, and when loaded with PBXN-5 to a density of 1.45 g/cc yields, after being drawn and shaped, a linear-shaped charge having a coreload of 12 grains per foot.)

The two samples of linear-shaped charges were tested by positioning them over a witness plate, with a first end on the plate and a second end elevated over the plate so that the charge recedes from the plate as sensed moving from the first end to the second end. Thus positioned, different points on the charge are disposed at different stand-off distances from the witness plate corresponding to variations in stand-off distance 18 from target 20, FIG. 1. The charge is initiated by a detonator at the elevated end and the depth of the cut into the witness plate by the linear charge is observed. In both cases, the deepest cut into the witness plate was seen where the charge was at a stand-off distance of about 0.075 inch. Since the tubes used to make the linear-shaped charges were thicker than desired and the coreloads of explosive were smaller than desired, the results of the test could not be directly compared to standard linear-shaped charge products having lead sheaths. Nevertheless, the results of the test of linear-shaped charges made with alloy No. 1 and alloy No. 2 show that such charges, when made according to standard specifications, will work as well as conventional lead-based products.

EXAMPLE 4B

Samples of mild detonating fuse were also prepared using tubes of alloy No. 1 and alloy No. 2 described above. The tubes had an outer diameter of 1 inch and an inner diameter of 0.35 inch. Before being filled with reactive material, the tubes were drawn to an outer diameter of 0.75 inch and an inner diameter of 0.343 inch. The tubes were then filled with PBXN-5 and were drawn to an outer diameter of 0.072 inch and had a core loading of PBXN-5 of 4.2 grains per foot. When tested, the mild detonating fuses made from both alloys exhibited detonation velocity in excess of the minimum specification of 7800 meters per second for lead-based products.

Tin-Silver Alloys

Although no test data are available for reactive products made with these alloys, it is believed that alloys comprised of tin and up to 4% silver would also be useful as a sheath material in accordance with the present invention. For example, alloys of tin with up to 3.5 percent silver have densities of in the range of about 0.265 to 0.375 lb/in$^3$, which generally exceed the density of alloy No. 2 (0.266 lb/in$^3$) and modern pewter (0.265 lb/in$^3$), and so are expected to provide better penetration performance than modern pewter. While the tensile strength of these tin-silver alloys is only about 3 ksi, which is lower than those of alloy No. 2 (5.5 to 6.2 ksi) and modern pewter (5–7 ksi), the elongation of these tin-silver alloys is estimated to be 88%, greater than the elongations of both alloy No. 2 (which has an elongation of 34–39%) and modern pewter (which has an elongation of 28–38%). Therefore, alloys consisting essentially of tin and silver, e.g., about 0.5 to 4 percent silver, will be easier to process than alloys No. 1 and No. 2 and will provide charges having comparable or better penetration performance.

While the invention has been described in detail with reference to particular preferred embodiments thereof, it will be appreciated by those skilled in the art that various alterations may be made to the invention as described, without departing from the intent and spirit of the invention, and it is intended to include such alterations within the scope of the invention and the appended claims.

What is claimed is:

1. A reactive product comprising a sheath at least partially encasing a reactive material selected from the group consisting of explosive material, deflagrating material, pyrotechnic material and a mixture of two or more thereof, the sheath comprising a tin-based alloy comprising from 96 to 99.9 percent tin; not more than about 1 percent antimony; not more than about 0.05 percent bismuth; and one of (a) from 0.1 to 3 percent copper and (b) from about 0.1 to 4 percent silver.

2. A reactive product comprising a sheath at least partially encasing a reactive material selected from the group consisting of explosive material, deflagrating material, pyrotechnic material and a mixture of two or more thereof, the sheath comprising a substantially silver-free tin-based alloy consisting essentially of from 97 to 99.9 percent tin; from 0.1 to 3 percent copper and not more than about 1 percent antimony.

3. The product of claim 2 wherein the tin-based alloy comprises about 1.5 percent or less copper and at least about 97.5 percent tin.

4. The product of claim 2 wherein the tin-based alloy comprises about 97 percent tin and about 3 percent copper.

5. A reactive product comprising a sheath at least partially encasing a reactive material selected from the group consisting of explosive material, deflagrating material, pyrotechnic material and a mixture of two or more thereof, the sheath comprising a substantially copper-free tin-based alloy consisting essentially of from 96 to 99.9 percent tin; from about 0.1 to 4 percent silver; and not more than about 1 percent antimony.

6. A reactive product comprising a sheath at least partially encasing a reactive material selected from the group consisting of explosive material, deflagrating material, pyrotechnic material and mixture of two or more thereof, the sheath comprising a tin-based alloy consisting essentially of tin and from about 0.1 to 4 percent silver and having an elongation of greater than about 30 percent and a density of greater than about 0.264 lb/in$^3$.

7. The reactive product of any one of claims 1, 2, 3, 4, 5 or 6 wherein the reactive material is in the form of a linear core and the sheath is in the form of a linear sheath circumferentially surrounding the core.

8. The reactive product of claim 7 comprising mild detonating cord.

9. The reactive product of claim 7 comprising ignition cord.

10. The reactive product of claim 7 comprising delay cord.

11. The reactive product of any one of claims 1, 2, 3, 4, 5 or 6 wherein the tin-based alloy comprises the liner of a shaped charge.

12. The reactive product of claim 11 comprising a shaped charge including a tamper and a shaped explosive material having a concave surface, the explosive material being disposed against the tamper with the concave surface of the explosive material facing away from the tamper, and wherein the liner is attached to the tamper and lines the concave surface of the explosive material and cooperates with the tamper to surround the explosive material between the tamper and the liner.

13. The product of claim 2 wherein the alloy comprises more than 99.5 percent tin.

14. The product of claim 2 wherein the alloy comprises less than 0.5 percent antimony.

15. The product of claim 2 wherein the alloy comprises less than 0.25 percent copper.

16. The reactive product of any one of claims 13, 14, or 15 wherein the reactive material is in the form of a linear core and the sheath is in the form of a linear sheath circumferentially surrounding the core.

17. The reactive product of claim 16 comprising mild detonating cord.

18. The reactive product of claim 16 comprising ignition cord.

19. The reactive product of claim 16 comprising delay cord.

20. The reactive product of any one of claims 13, 14 or 15 wherein the tin-based alloy comprises the liner of a shaped charge.

21. The reactive product of claim 20 comprising a shaped charge including a tamper and a shaped explosive material having a concave surface, the explosive material being disposed against the tamper with the concave surface of the explosive material facing away from the tamper, and wherein the liner is attached to the tamper and lines the concave surface of the explosive material and cooperates with the tamper to surround the explosive material between the tamper and the liner.

* * * * *